United States Patent [19]

Galloway

[11] Patent Number: 4,879,824

[45] Date of Patent: Nov. 14, 1989

[54] FLOATING PICTURE FRAME

[76] Inventor: Joanne Galloway, P.O. Box 520, Franklin, Mich. 48025

[21] Appl. No.: 200,571

[22] Filed: May 31, 1988

[51] Int. Cl.[4] ..... A47G 1/06

[52] U.S. Cl. ..... 40/152.1; 40/661; 40/152

[58] Field of Search ..... 40/661, 160, 152.1, 40/152, 157; 248/466, 488

[56] References Cited

U.S. PATENT DOCUMENTS

| | | | |
|---|---|---|---|
| 2,568,165 | 9/1951 | Oberding | 40/152 |
| 3,771,244 | 11/1973 | Ebner | 40/152 |
| 3,988,846 | 11/1976 | Kuhling | 40/152.1 |
| 4,055,319 | 10/1977 | Pendock | 248/488 |
| 4,211,022 | 7/1980 | Angelakos | 40/152.1 |
| 4,244,303 | 1/1981 | Kurasik | 40/152 |
| 4,356,650 | 11/1982 | Antonczyk et al. | 40/642 |

*Primary Examiner*—Gene Mancene
*Assistant Examiner*—Cary E. Stone
*Attorney, Agent, or Firm*—Krass & Young

[57] ABSTRACT

A picture frame assembly for suspensibly mounting an art work to a vertical surface. The picture frame assembly comprises two vertical, transparent, opposed, spaced and parallel brackets having longitudinal grooves formed therein. The art work to be displayed is sandwiched between a foam core backing and a transparent front plate. The resulting sandwich assembly is mounted in the grooved brackets such that its top and bottom edges are engaged in the grooves thereof. The side rails may be installed to engage the sandwich assembly on both sides. The brackets are then mounted to the wall. A clear, Lucite cover is then mounted on the wall such that it encloses all exposed sides of the brackets and sandwich assembly. The picture frame assembly both protects and preserves the art work mounted therein and attaches it to the wall in a manner that gives the impression that the art work is floating or is suspended in space.

6 Claims, 1 Drawing Sheet

FLOATING PICTURE FRAME

FIELD OF THE INVENTION

This invention relates to the field of frames for pictures or other items to be displayed, and, more particularly to such a frame which both protects and preserves the display item and gives it the appearance of floating or being suspended in space.

DESCRIPTION OF THE RELEVANT PRIOR ART

It has long been the custom to display paintings, prints, lithographs, drawings, and other such artworks on the wall of a gallery or room. Almost universally, such artistic items of a graphic nature are displayed in conventional picture frames which serve to enclose the edges of the object. A typical picture frame assembly normally includes the frame elements, which may be rectangular, square, oval, etc., a pice of glass for protecting the front of the picture, and a rigid backing material which serves to both prevent the picture from curling or warping and also to give stability and rigidity to the frame assembly.

Obviously, there are some variations in this basic, prior art picture frame assembly. For example, the art object may first be mounted or tacked onto a rigid backing and it may be matted before it is framed. Some picture frames also include means of illumination for lighting the displayed piece, or may employ some sort of mechanism for producing a moving display of a continuous picture. Despite these variations, the basic arrangement is the same.

While a conventional picture frame serves the function of framing the graphic art object, thus serving to draw the onlooker's eye to the thereto, it is not completely suitable for all types of graphic art. This is particularly true of very contemporary pieces, such as those produced by minimalist or post modern artists. With art work of this type, a conventional picture frame tends to detract from the appearance of the piece of art. The conventional picture frame clutters the piece and distracts the onlooker's eye from observation of the art work itself. Thus, the total effectiveness of the graphic work is reduced when it is displayed conventionally.

Furthermore, such conventional picture frames are mounted flush against the wall. This flush mounting tends to create an impression of two-dimensionality, making the art work look like a fresco or wall painting. Such flush mounting does not create the most effective display for some very contemporary art pieces which would lend themselves to a more three dimensionally oriented style of display.

Furthermore, use of conventional, flush mounted picture frames for display of art pieces may not harmonize with the decor of rooms and galleries furnished with certain styles of contemporary furniture. There has been a tendency in contemporary and avant-garde interior design toward the increasing use of furniture which seems to "float", rather than to rest on conventional legs or frames. This is sometimes accomplished by the use of bases and legs of transparent acrylic or Lucite, or sometimes by the use of opaque, black bases on which tabletops or cushions are supported. By use of such devices, a look of spaciousness and minimal clutter is created. A conventional picture frame appears out of place in such a decor.

In addition to its decorative function, a picture frame assembly also serves to preserve and protect the art work contained therein. However, a conventional picture frame assembly may fail to provide this function since dust, fumes, air pollution, etc. may penetrate the assembly, particularly at the corners of the frames, thus causing the art work to age prematurely. Additionally, any method used to mount the artwork in conventional framing necessitates an adhesion of some type to the back surface of the artwork, thereby reducing its market value.

It would be desirable to provide an assembly suitable for displaying a piece of graphic art which minimizes the visual impact of the actual frame.

It would also be desirable to provide such a frame assembly compatible with both contemporary graphic art and the decors of rooms or galleries in which such art work is to be displayed.

It would also be desirable to provide such a frame assembly which is not flush mounted against the wall, but rather gives the graphic work the appearance of floating, or being suspended in space.

Finally, it would be desirable to provide such an assembly which more effectively serves the function of both preserving and protecting the art work contained therein, thereby retaining its intrinsic value.

SUMMARY OF THE INVENTION

Disclosed and claimed herein is a frame assembly for display of a graphic art work, said assembly giving the displayed art work the illusion of floating in space. The frame assembly comprises a pair of vertically disposed, opposed, parallel and spaced brackets, each bracket having a groove disposed along the length thereof. The art work to be displayed is sandwiched between a foam core backing and a transparent front plate. The grooves in the brackets are sized to receive the top and bottom edges of the sandwich assembly therein. Optionally, a pair of parallel and disposed side rails may also be provided, which likewise have longitudinal grooves formed therein to receive the side edges of the sandwich assembly. Means are provided for mounting the bracketed sandwich assembly to the wall. A transparent cover is provided of sufficient dimensions as will serve to enclose the edges and front face of the mounted bracketed sandwich assembly, said cover having a top and side walls which are in spaced relation from the mounted brackets, side rails and sandwich assembly. Means for mounting the cover on the wall are also provided.

It is contemplated that the grooved brackets and side rails will be formed of a transparent, thermosetting, machinable plastic such as that commonly available and sold under the trademark Lucite. Likewise, it is desirable that the transparent cover also be formed of Lucite plastic. The means for mounting the brackets to the wall and for mounting the cover to the wall may be any conventional fastening means such as nails, screws, molly bolts, etc. Preferably, anchor holes are formed in the brackets and cover for insertion of the fasteners. In order to minimize their visual impact the thereby minimize the cluttered appearance which said fasteners might conceivably lend the mounted display item, it is highly desirable that the fasteners be fabricated to be as unobtrusive as possible. For example, the heads of such fasteners could be fabricated of a transparent material such as plastic.

The grooved brackets and side rails are formed of transparent material in order to render them nearly invisible when the art work is mounted therein. To this end, the brackets and side rails are mounted transversely with respect to the wall such that only their edges are visible when the art work is viewed straight on. This further minimizes the visual impact of these supporting structures. The brackets and side rails support the art work in spaced and parallel relation from the wall on which they are mounted. Hence, rather than appearing flat on the wall, the art work appears to be suspended in space with no visible means of support. This effect is further heightened by the transparent cover which is placed over the mounted art work. The transparent cover serves to enclose a three-dimensional space in which the art work appears to be floating. Again, this effect is further heightened by rounding the front edges of the cover box so that they are nearly invisible.

Furthermore, because the art work is completely enclosed by the brackets, side rails, cover plate and foam backing, it is protected from exposure to harmful chemicals found in the ambient air. The cover box which encloses all exposed faces and sides of the mounted art object further serves to protect ant preserve the object displayed therein. Thus, the art work is doubly protected from the deleterious effects of the outside environment.

BRIEF DESCRIPTION OF THE DRAWING

The herein invention can best be understood by reference to the following detailed description and drawing in which:

FIG. 2 is a front elevational view of the picture frame assembly of FIG. 1;

DETAILED DESCRIPTION OF THE PREFERRED EMBODIMENT

Figure 1:
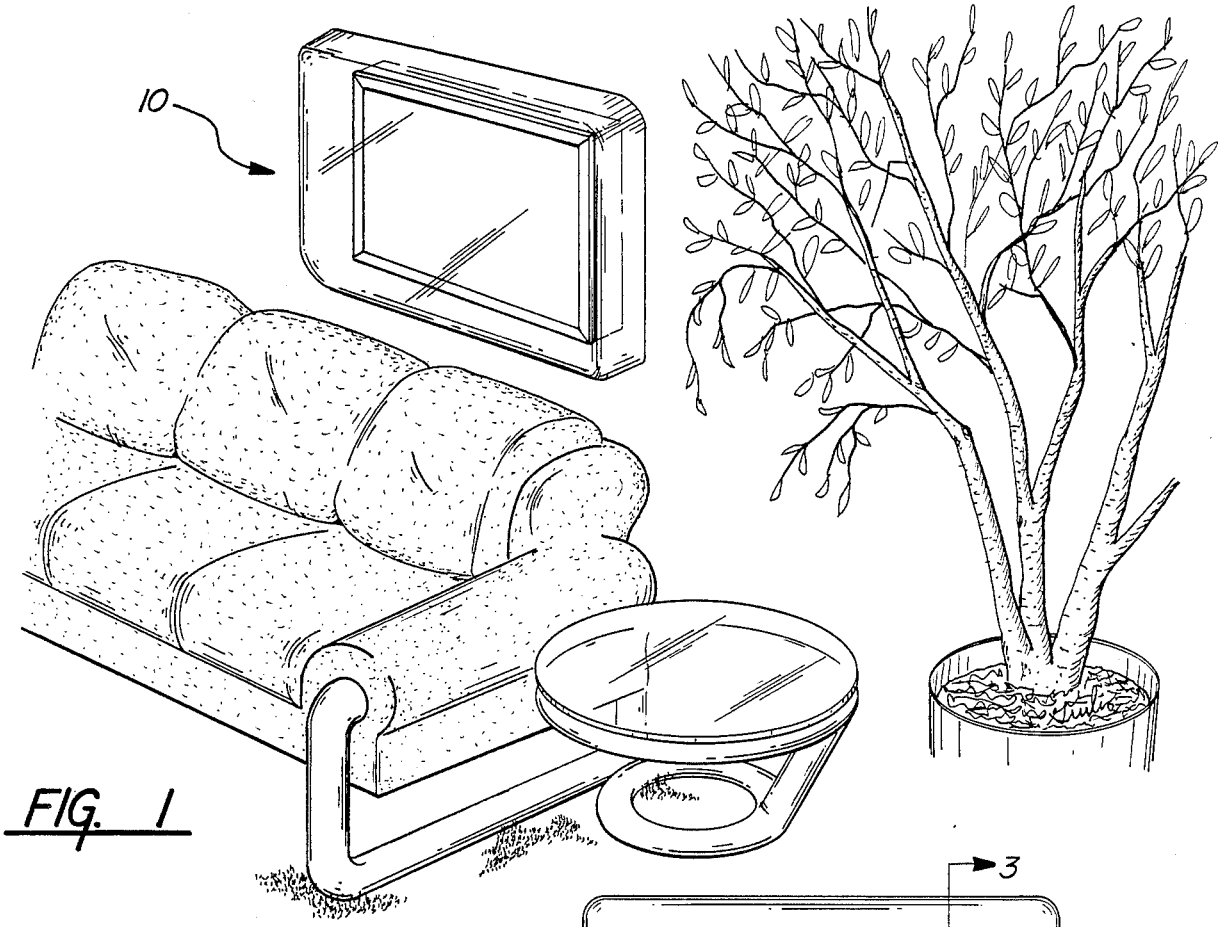

Throughout the following detailed description, like reference numerals are used to refer to the same feature of the herein invention shown in multiple figures thereof.

Figure 2:
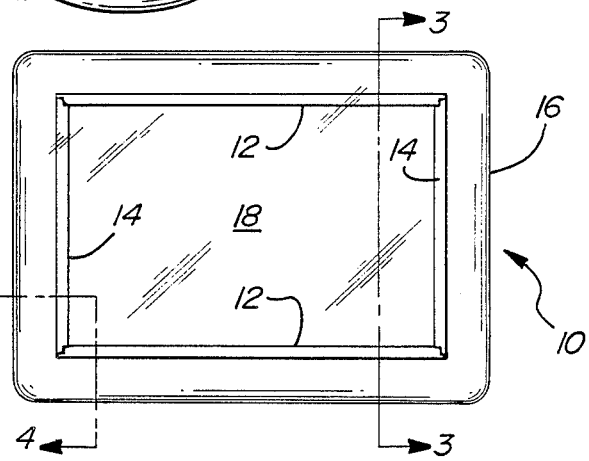
FIG. 2 shows the picture frame assembly of the instant invention mounted on the wall of a room.
Figure 3:
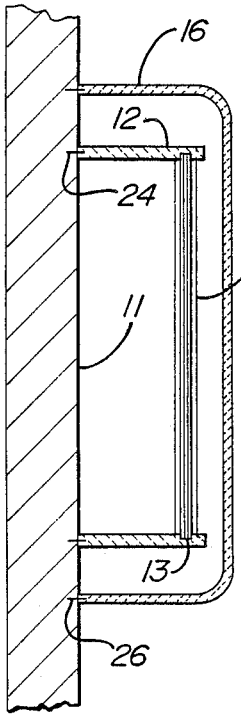
FIG. 3 is a cross sectional view of the picture frame assembly of FIG. 1 taken along the lines 3—3.
Figure 4:
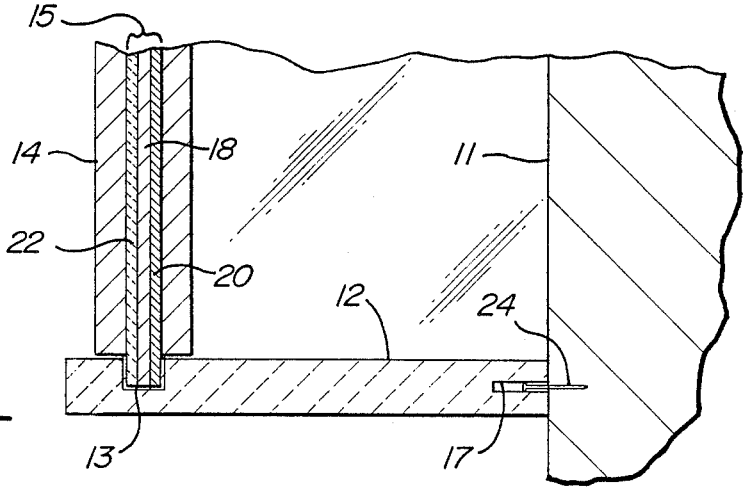
FIG. 4 is a detailed view of FIG. 3 showing details of the construction of a bracket and side rail.

Referring now to the drawings and in particular to FIGS. 1 and 2, there is shown a picture frame assembly 10 of the instant invention. A pair of opposed brackets 12 arranged in spaced and parallel relationship are provided, and a pair of opposed side rails 14 also in spaced and parallel relation connect the pair of brackets 12. As can be seen in FIGS. 3 and 4 a groove is formed in each bracket 12 and a similar groove (not shown) is formed in each side rail 14.

The picture frame assembly 10 of the instant invention further comprises a sandwich assembly 15 formed by a art object 18 to be displayed which is sandwiched between a foam core backing 20 contiguous therewith and a transparent front plate 22 also contiguous therewith. Typically, the front plate 22 will comprise a sheet of transparent material such as plate glass or, if desired, non-glare glass. The grooves 13 formed in brackets 12 are sized appropriately to receive the top and bottom edges of the sandwich assembly 15. The brackets 12 further comprises means 24 for attaching them to a wall 11, as can be seen in FIGS. 3 and 4. Typically, anchor holes 17 may be machined in brackets 12 in order to accommodate fastening means 24. Fastening means 24 may comprise any conventional fastening means used to attach objects to a vertical surface, such as screws, anchor bolts, nails, etc. Similarly, fastening means 26 are also provided to attach a cover box 16 to wall 11, as shown in FIG. 3.

Cover box 16 has appropriate dimensions to accommodate all exposed sides and edges of sandwich assembly 15 after it has been placed within brackets 12 and side rails 14 and mounted on wall 11. As can be seen in FIGS. 2 and 3, it is preferable that the sides and front face of cover box 16 be spaced apart from the bracketed art work 18 in order to create the illusion that art work 18 is floating in space, as discussed earlier.

Typically, grooves 13 will be formed in brackets 12 such that when the assembly 10 is mounted to wall 11, sandwich 15 will be in spaced and parallel relation therefrom. This further heightens the "floating" effect. Typically, picture frame assembly 10 will suspend picture 18 approximately 3 or so inches from wall 11. It has also been found that if the dimensions of cover box 16 are made such that the width and height thereof are approximately 4 inches greater on all sides than those respectively of sandwich 15 and the depth of cover box 16 is made approximately 5 or 6 inches, the floating effect will be maximized.

Obviously, while a rectangular picture frame assembly has been illustrated and described herein, the principles of the instant invention could also be utilized to construct picture frame assemblies of other configurations. For example, if it is desired to display an art work which is oval, circular, or square in shape, the principles of the herein invention may be modified to accommodate such an art work. Furthermore, while the brackets and side rails depicted herein are illustrated as solid structures, it is possible that they may be hollowed or otherwise cut out in order to reduce the weight of the entire assembly without substantially diminishing the effectiveness of the display achieved. Furthermore, in order to add rigidity and stability to the assembly, various cross pieces or braces may be utilized by one skilled in the art to connect the grooved brackets and side rails. Such variations are considered within the skill of one adept in the art and do not depart from the spirit of the instant invention. Although the herein invention has been described with reference to certain exempliciations and embodiments thereof, it is not intended to be limited so but solely by the claims appended hereto.

I claim:

1. A picture frame assembly comprising:

a pair of horizontally disposed, opposed, parallel and spaced transparent brackets, each bracket having means forming a groove disposed along the length thereof proximate a first edge thereof;

a sandwich assembly formed by a backing, a picture, and a transparent front plate, all of approximately equal size, said grooves in the brackets being sized to receive and retain substantially all of the length of the top and bottom of said sandwich therein;

means for mounting a second edge of each of the brackets on a wall, said second edge disposed spaced from and parallel to said first edge such that the sandwich retained by the grooves is supported in spaced and parallel relation thereto, which is cooperation with the transparent brackets creates the visual illusion that the picture is floating in space;

a transparent cover adapted to enclose the edges and front face of the mounted, bracketed sandwich assembly and be spaced therefrom; and means for mounting the cover on the wall.

2. The picture frame assembly of claim 1 further comprising a pair of transparent, grooved side rails for receiving the side edges of the sandwich assembly therein.

3. The picture frame assembly of claim 2 wherein the side rails and brackets have front edges which are configured to be arcuate.

4. The picture frame assembly of claim 1 wherein the brackets have front and back faces, the grooves being disposed in proximity to the front faces.

5. The picture frame assembly of claim 1 wherein the cover has front edges which are configured to be arcuate.

6. The picture assembly of claim 1 wherein the brackets are formed of Lucite®.

* * * * *

UNITED STATES PATENT AND TRADEMARK OFFICE

CERTIFICATE OF CORRECTION

PATENT NO. : 4,879,824

DATED : November 14, 1989

INVENTOR(S) : Galloway

It is certified that error appears in the above-identified patent and that said Letters Patent is hereby corrected as shown below:

Column 2, line 62 "the" should be --and--;

Column 3, line 25 "ant" should be --and--;

Column 3, line 34 "FIG. 2" should be --FIG. 1--;

Column 3, line 55 after "groove" insert --13--;

Column 4, line 48 "exempliciations" should be --exemplifications--;

Column 4, line 62 after "bottom" insert --edges--;

Column 4, line 67 "is" should be --in--.

Signed and Sealed this

Twelfth Day of February, 1991

*Attest:*

HARRY F. MANBECK, JR.

*Attesting Officer*

*Commissioner of Patents and Trademarks*